US006412140B1

(12) United States Patent
Fleissner

(10) Patent No.: US 6,412,140 B1
(45) Date of Patent: Jul. 2, 2002

(54) SUCTION DEVICE FOR A TEXTILE MACHINE, ESPECIALLY A WATER NEEDLING UNIT

(75) Inventor: Gerold Fleissner, Zug (CH)

(73) Assignee: Fleissner GmbH & Co., Maschinenfabrik, Egelsbach (DE)

( * ) Notice: Subject to any disclaimer, the term of this patent is extended or adjusted under 35 U.S.C. 154(b) by 84 days.

(21) Appl. No.: 09/588,001

(22) Filed: Jun. 6, 2000

(30) Foreign Application Priority Data

Jun. 6, 1999 (DE) ..... 199 25 703

(51) Int. Cl.[7] ..... D06G 5/00; B08B 5/04
(52) U.S. Cl. ..... 15/309.1; 28/104
(58) Field of Search ..... 15/306.1, 309.1, 15/309.2; 28/104, 105; 26/1

(56) References Cited

U.S. PATENT DOCUMENTS 3,119,140 A * 1/1964 Sallet
3,841,910 A * 10/1974 Baker
5,727,292 A * 3/1998 Vuillaume

* cited by examiner

*Primary Examiner*—Terrence R. Till
(74) *Attorney, Agent, or Firm*—Antonelli, Terry, Stout & Kraus, LLP

(57) ABSTRACT

The suction slit between two sliding strips for a transport device transporting the textile material is filled by a cleaning strip which has holes on one side to carry away the fluid to be drawn off and preferably on the other side as well, on the top of a separating strip, to determine the width of the suction slit. In this fashion, the fibers loosened by needling come to rest on the ribs of the holes in the cleaning strip and not on the ribs on the openings in the suction tube and thus can be removed quickly from the suction device by replacing the cleaning strip. In addition, the width of the effective suction slit can be changed quickly by replacing it by another cleaning strip in which the width of one or two separating strips is dimensioned accordingly.

15 Claims, 2 Drawing Sheets

SUCTION DEVICE FOR A TEXTILE MACHINE, ESPECIALLY A WATER NEEDLING UNIT

BACKGROUND OF THE INVENTION

The invention relates to a suction device for fluids, especially in water needling machines in which a water beam is located outside the suction device for producing streams of fluid, possibly consisting of a suction tube with suction openings located over the working length of the tube, through which the fluid is drawn up by a vacuum produced in the tube, and sliding strips are located on both sides of and parallel to the openings along the tube to support a transport means such as a drum for the web-shaped product to be needled. The fixed suction tube must be made very stable because the vacuum to be produced is between 20 and 400 mbar. The suction tube is therefore made with a thick wall in which the suction openings are drilled. Openings made laterally along an axially parallel jacket line then form the sliding strips for the drum to be transported or a strip is provided which defines the effective suction slit by its distance.

It has been found that the width of the suction slit must be changed as a function of the transport speed of the drum or the weight of the nonwoven or the like for optimizing the suction performance, since the dewatering process is of critical importance for the needling effect. There is also the danger that the suction slit will become blocked by fiber residue, so that regular cleaning is required.

SUMMARY OF THE INVENTION

The goal of the invention is both to permit simple cleaning and also a rapid change in the width of the suction slit.

Beginning with the suction device of the type described at the outset, the solution to the problem consists in providing a replaceable cleaning strip between the sliding strips. All possible changes and sizes can be provided with this strip which can be inserted at the end, something which is not possible for the openings of the suction tube or on the permanently arranged suction strips.

The invention is not limited to water needling machines but also applies to any suction devices used in the textile industry for necessary dewatering of material.

BRIEF DESCRIPTION OF THE DRAWINGS

A device of the type according to the invention is shown for example in the drawings. Additional inventive details will now be explained with reference to this example.

FIG. 1 shows in cross section, a roller for hydrodynamic needling of a nonwoven or the like;

DETAILED DESCRIPTION OF THE PREFERRED EMBODIMENTS

Figure 1:
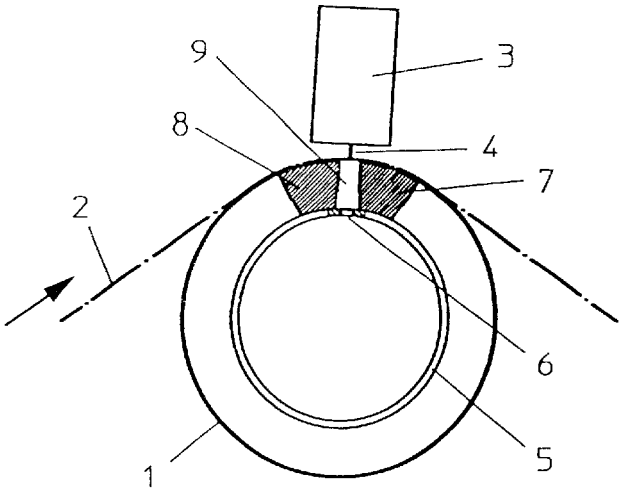

The suction device consists for example of a fluid-permeable rotatably mounted drum 1 on which the material 2 to be needled rests. Drum 1 is located below a water beam 3 from which water streams 4 emerge under high pressure and strike material 2. The sprayed water is to be drawn off immediately below material 2. For this purpose, a suction tube 5 is mounted centrally in a fixed position within drum 1, in the wall of which tube suction openings 6 are made along a jacket line. To the right and left of these openings 6, parallel to the jacket line radially outside tube 5, sliding strips or the like 7, 8 are provided in a fixed location to determine the width of suction slit 9.

Figure 2:
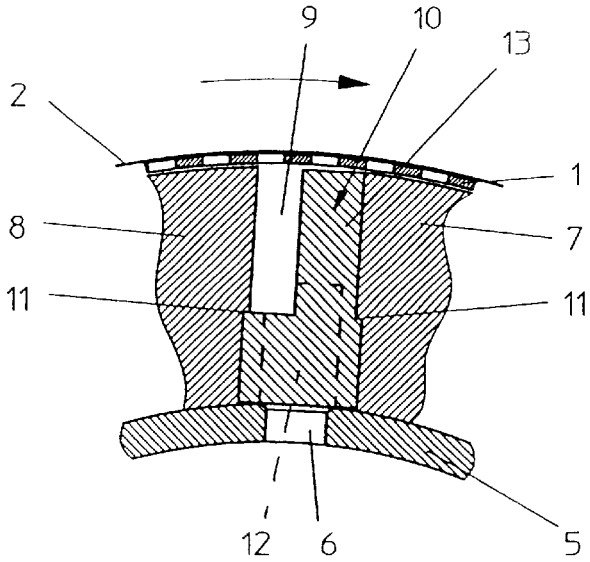
FIG. 2 is an enlarged view of the suction slit in FIG. 1.

The details follow from FIG. 2 The distance between sliding strips 7, 8 no longer determines the width of suction slit 9 but a cleaning strip 10 that can be pushed in endwise of the suction device into slit 9. The cleaning strip 10 is supported on suction tube 5 and is also defined in its position radially outward by a bilateral milled groove 11 in sliding strips 7, 8 and in cleaning strip 10 as well.

Figure 3:
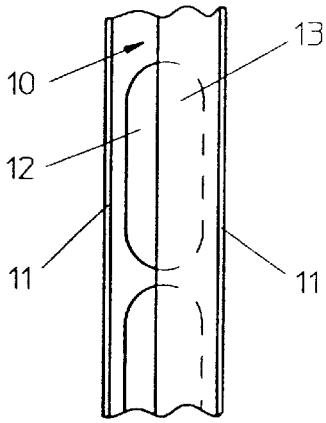
FIG. 3 is a top view of the cleaning strip between the sliding strips of the suction tube.

Cleaning strip 10 according to the view in FIG. 3 has elongate holes 12 in the lower part of cleaning strip 10 in order to allow the suction from suction tube 5 to act fully. It is advantageous when the ribs between openings 6 in suction tube 5 are covered at least partially by the ribs between openings 12 in cleaning strip 10 so that the fibers are deposited on the ribs of cleaning strip 10 and not on the ribs of suction tube 5. This permits rapid cleaning of suction slit 9, 6 by externally performed cleaning or rapidly by replacing cleaning strip 10.

Cleaning strip 10 also fulfills the purpose of rapidly changing the slit width of suction slit 9'. This is accomplished by means of a separating strip 13 which is part of cleaning strip 10 and is located in the upper part of cleaning strip 10. Cleaning strip 10 fills the space between sliding strips 7, 8, but separating strip 13 defines the width of suction slit 9' by its width. It is located on one side, the right side in this case, of cleaning strip 10 and depending on its width partially covers elongate holes 12 Therefore, separating strip 13 is eccentric, located on one side in suction slit 9 and has only one flange on one sliding strip 7. The other flange determines the width of suction slit 9' up to the opposite flank of sliding strip 8. The flank of the separating strip that abuts the flange of sliding strip 7 is provided on the downward side of rotating drum 1. This prevents bending of separating strip 13 which is narrow.

Figure 4:
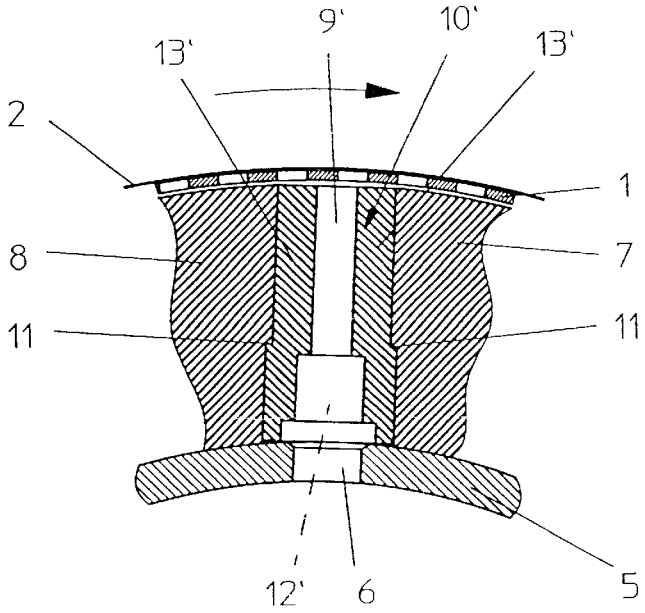
FIG. 4 is another design of the suction slit like that in FIG. 2.
Figure 5:
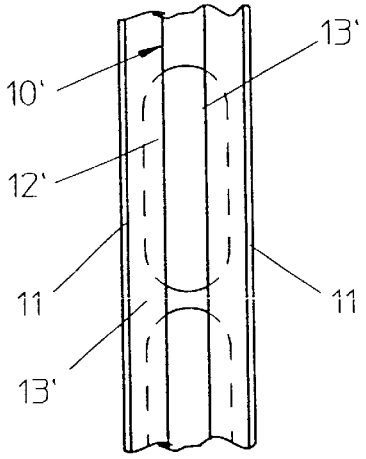
FIG. 5 is a top view of the cleaning strip according to FIG. 4.

According to FIGS. 4 and 5, however, another design of the cleaning strip is also possible. According to this design, suction slit 9' of cleaning strip 10' for every slit width is located radially above suction opening 6 in suction tube 5.

Thus, a separating strip 13' is provided on both sides of suction slit 9' which abut the flanks of the two sliding strips 7, 8. Suction slit 9' is also located radially above openings 12' on the bottom of cleaning strip 10', as can also be seen from FIG. 5. This design of cleaning strip 10' avoids dirty corners in the vicinity of milled groove 11, which in the design according to FIG. 2 has an edge that extends into the water flow path in the vicinity of suction slit 9'.

What is claimed is:

1. A suction device for fluids, especially in water needling machines, in which a water beam is located outside the suction device to produce fluid streams, comprising a suction tube with suction openings located over a working length of the tube, through which the fluid is drawn off by the vacuum produced in the tube, and sliding strips located on both sides of and parallel to the openings along the tube to support a transport means for the web-shaped product to be needled, characterized in that a replaceable cleaning strip is mounted between the sliding strips.

2. The suction device according to claim 1, characterized in that the cleaning strip is mounted to slide in and out endwise of the suction tube.

3. The suction device according to claim 1, characterized in that the cleaning strip is supported on the suction tube.

4. The suction device according to claim 1, characterized in that the cleaning strip is designed as a shoe whose widest part rests on the suction tube.

5. The suction device according to claim 1, characterized in that the through flow openings are made in the cleaning strip, whose ribs cover ribs on the suction openings of the suction tube.

6. The suction device according to claim 5, characterized in that the through flow openings of the cleaning strip are made in the form of elongate holes.

7. The suction device according to claim 5, characterized in that the through flow openings of the cleaning strip have a variable cross section.

8. The suction device according to claim 5, characterized in that the cleaning strip has a lower part associated with the suction tube and an upper part associated with the transport means, and that the through-flow openings of the cleaning strip are located in the lower part associated with the suction tube, and the upper part associated with the transport means has a variable width separating strip for changing the effective suction slit.

9. The suction device according to claim 8, characterized in that the distance between the two sliding strips is filled by the cleaning strip and in the lower part, depending on the width of the separating strip, the latter at least partially covers the through flow openings of the cleaning strip.

10. The suction device according to claim 9, characterized in that the separating strip is radially flush externally with sliding strips in the upper part associated with drum, and in the lower part, depending on the width of the separating strip, the separating strip covers the through flow openings of cleaning strip at least partially.

11. The suction device according to claim 9, characterized in that the separating strip is located on only one side of cleaning strip and the effective suction slit is thus formed by one wall of the separating strip and by the opposite wall of the sliding strip or the like.

12. The suction device according to claim 9, characterized in that the separating strip is located in the direction of rotation of the transport means as viewed on the side of the sliding strip that is descending, and abuts only this sliding strip.

13. The suction device according to claim 9, characterized in that not just one, but two separating strips determine the width of the effective suction slit, these separating strips have the same width, and the effective suction slit is thus located in the middle between sliding strips.

14. The suction device according to claim 8, characterized in that the effective suction slit of the cleaning strip is located radially above the suction opening of suction tube.

15. The suction device according to claim 1,′ characterized in that the transport means comprises a drum.

* * * * *